US006133694A

United States Patent [19]

Cekic et al.

[11] Patent Number: 6,133,694

[45] Date of Patent: Oct. 17, 2000

[54] HIGH-PRESSURE LAMP BULB HAVING FILL CONTAINING MULTIPLE EXCIMER COMBINATIONS

[75] Inventors: Miodrag Cekic; Jerome Frank, both of Bethesda, Md.; Svetozar Popovic, Norfolk, Va.

[73] Assignee: Fusion UV Systems, Inc., Gaithersburg, Md.

[21] Appl. No.: 09/306,713

[22] Filed: May 7, 1999

[51] Int. Cl.[7] ..... H01J 17/20; H01J 61/12

[52] U.S. Cl. ..... 313/570; 313/567; 313/568; 313/572

[58] Field of Search ..... 313/567, 568, 313/570, 572

[56] References Cited

U.S. PATENT DOCUMENTS

| | | | |
|---|---|---|---|
| 3,778,661 | 12/1973 | Gedanken et al. | 313/567 |
| 4,002,922 | 1/1977 | Young . | |
| 4,075,505 | 2/1978 | Young . | |
| 4,081,712 | 3/1978 | Bode et al. | 313/567 |
| 4,334,199 | 6/1982 | Ham . | |
| 4,710,679 | 12/1987 | Budinger et al. . | |
| 5,194,740 | 3/1993 | Kogelschatz et al. . | |
| 5,239,551 | 8/1993 | Roberts et al. . | |
| 5,307,364 | 4/1994 | Turner . | |
| 5,343,114 | 8/1994 | Beneking et al. | 313/570 |
| 5,363,019 | 11/1994 | Itatani et al. . | |
| 5,504,391 | 4/1996 | Turner et al. | 313/570 |
| 5,659,567 | 8/1997 | Roberts et al. . | |
| 5,838,108 | 11/1998 | Frank et al. . | |
| 5,854,535 | 12/1998 | Hohlfeld et al. | 313/570 |
| 5,886,466 | 3/1999 | Bell et al. | 313/569 |

FOREIGN PATENT DOCUMENTS 3046 894 7/1982 Germany .

OTHER PUBLICATIONS

J.R. Murray et al. —The possibility of high–energy–storage lasers using the auroral and transauroral transitions of column–VI elements*+; Journal of Applied Physics, vol. 47, No. 47, pp. 5041–5058, Nov. 11, 1976.

William M. Hughes—Experiments on 558–nm argon oxide laser system; Applied Physics Letters vol. 28, No. 2, pp. 81–83, Jan. 15, 1976.

H.T. Powell et al.—Laser Oscillator on the Green Bands of XeO and $KrO^+$; Applied Physics Letters, vol. 25, No. 12; pp. 730–732, Dec. 15, 1974.

R.J. Donovan et al. —Collisional Deactivation of the Electronically Excited Atoms, $S(3^1S_0)$, by the Noble Gases, Dept. of Physical Chemistry, Univ. of Cambridge rec'd Jul. 17, 1969, pp. 774–779.

(Recorded) Excimer and Energy Transfer Lasers—D.C. Lorents and D.L. Huestis, Stanford Research Institute Reference: Proceedings of the 2nd Int'l Conference Laser Spectroscopy. Megeve, France (Jun. 23–27, 1975) pp. 100–111.

J.E. Velazco et al.—Bound–free emission spectra of diatomic xenon halides; The Journal of Chemical Physics, vol. 62, No. 5, pp. 1990–1991, Mar. 1, 1975.

*Primary Examiner*—Michael H. Day
*Assistant Examiner*—Mariceli Santiago
*Attorney, Agent, or Firm*—Shlesinger Arkwright & Garvey LLP

[57] ABSTRACT

A high pressure lamp bulb adapted to simultaneously emit distinct emission spectra of a desired wavelength, the lamp bulb comprising an envelope for containing a fill material under pressure and a fill material, the fill material including a material capable of forming at least two dissimilar excimer species in an amount to provide a total fill pressure no less than about 750 Torr at room temperature.

14 Claims, 5 Drawing Sheets

Spectrum of $Xe/Cl_2$ mixture

Spectrum of $Xe/Cl_2$ mixture

Spectrum of $Xe/O_2$ mixture

Spectrum of particular $Xe/Cl_2/O_2$ mixture

HIGH-PRESSURE LAMP BULB HAVING FILL CONTAINING MULTIPLE EXCIMER COMBINATIONS

FIELD OF THE INVENTION

The present invention is directed to an improved excimer lamp bulb.

BACKGROUND OF THE INVENTION

A variety of commercial processes employ ultraviolet (UV) radiation for treating materials. For example, ultraviolet radiation is used to polymerize photopolymer coatings. Photopolymer coatings find widespread use as protective surface coatings, printing inks and in the production of printed circuits.

Ultraviolet lamps have been developed for irradiation of photocurable coatings. The ultraviolet lamp typically utilizes a bulb fill which contains mercury together with various additives to emphasize a particular region or regions of the light spectrum.

In many instances, the geometry or thickness of the coating requires a rich spectrum of radiation be applied if efficient polymerization is to be achieved. More particularly, the surface of the coating typically requires shorter wavelength photons be applied for efficient absorption within the first several molecular layers of the coating thereby insulating the film from the loss of the activated chemical species to the surrounding media. The bulk of the coating requires somewhat longer wavelength photons that have the ability to penetrate the coating more deeply than do the shorter wavelength photons. As is apparent, the spectral energy density distribution is empirically determined prior to application and the appropriate spectrum of irradiation selected. Since prior art UV lamps are unable to provide regions of the spectrum that are carefully tailored to the photochemical requirements of many photocurable coatings, a compromise spectrum is usually selected or in the alternative, two lamps are used for the cure, one emitting predominately longer wavelengths while the other optimized to emit predominately shorter wavelengths. This results in an inferior, less desirable and lower quality cure of the coating not to mention the added cost for having to use two separate lamps for the cure.

In recent years, discharge devices which emit so-called excimer radiation have become known. Excimers are unstable excited molecules that possess an unbound or weakly bound ground state. That is, the excimer molecules exist only in the excited states. The excimer molecules disintegrate within less than a microsecond, and during their decay give off their binding energy in the form of radiation in a relatively narrow band.

U.S. Pat. No. 5,504,391 to Turner et al. discloses a class of lamps that produces a single narrow band of emission frequencies. Since this prior art lamp is based upon an excimer emission systems, the spectral power density of the lamp, normalized to the excimer emission peak, has been shown to be invariant with respect to the excitation power. Consequently, the only variable that the operator has any control over is total power. Further, and for the reasons earlier stated, single narrow band emissions are suboptimally matched to many commercial applications and in particular photopolymerization applications requiring a rich spectrum for efficient polymerization.

In summary, spectral adjustment of prior art high pressure, high voltage ignited microwave bulbs containing a single rare gas-halogen excimer is limited to variation of light intensity with power input and a minor variation in the line shape of the dominant transitions by varying the bulb fill. As it is apparent, such adjustments fall short from that desired for many applications.

OBJECTS AND SUMMARY OF THE INVENTION

An object of the present invention is to provide two or more different excimer systems within a single high pressure lamp bulb.

It is therefor an object of the present invention to provide a high pressure excimer lamp adapted for photocuring applications which provides a balance between surface light absorption and gradual light absorption in the coating to be cured.

It is still further object of the present invention to provide a high pressure excimer lamp fill having controlled and continuous variability of two or more lines in the spectrum.

It is a further object of the present invention is to provide a high pressure excimer lamp having a fill adapted to produce radiation sufficient to simultaneously polymerize several dissimilar polymers within a composite polymer matrix coating.

It is another object of the present invention to provide a high pressure excimer lamp bulb having a fill comprising at least two separate excimers so as to simultaneously provide at least two different emission frequencies.

It is still further object of the present invention to provide an excimer lamp having improved controllability of the emission spectrum.

Yet another object of the present invention is to provide an excimer lamp bulb having fill pressures greater than about 750 Torr to permit sufficient number densities of excimer precursers and thereby allow competitive existence of different excimer species simultaneously.

A still further object of the present invention is to provide a multiple excimer lamp bulb capable of producing a spectrum that is more precisely specified as to both peak emission wavelengths and the ratio of the emission peaks.

Yet another object of the present invention is to provide an excimer lamp bulb having a pressure and fill ratio which provides a spectrum of radiation desirably and appropriately matched to the photoinitiator chemistry of the coating to be cured so that a high quality cure is achieved.

In summary and in accordance with the broadest aspect of the present invention, an excimer lamp bulb is provided having a fill comprising at least two excimer species and at a total fill pressure above about 750 Torr at operating temperature.

These and other objects will be apparent from the following detailed descriptions together with the drawings.

BRIEF DESCRIPTIONS OF THE DRAWINGS

DETAILED DESCRIPTION OF PREFERRED EMBODIMENTS

Figure 1:
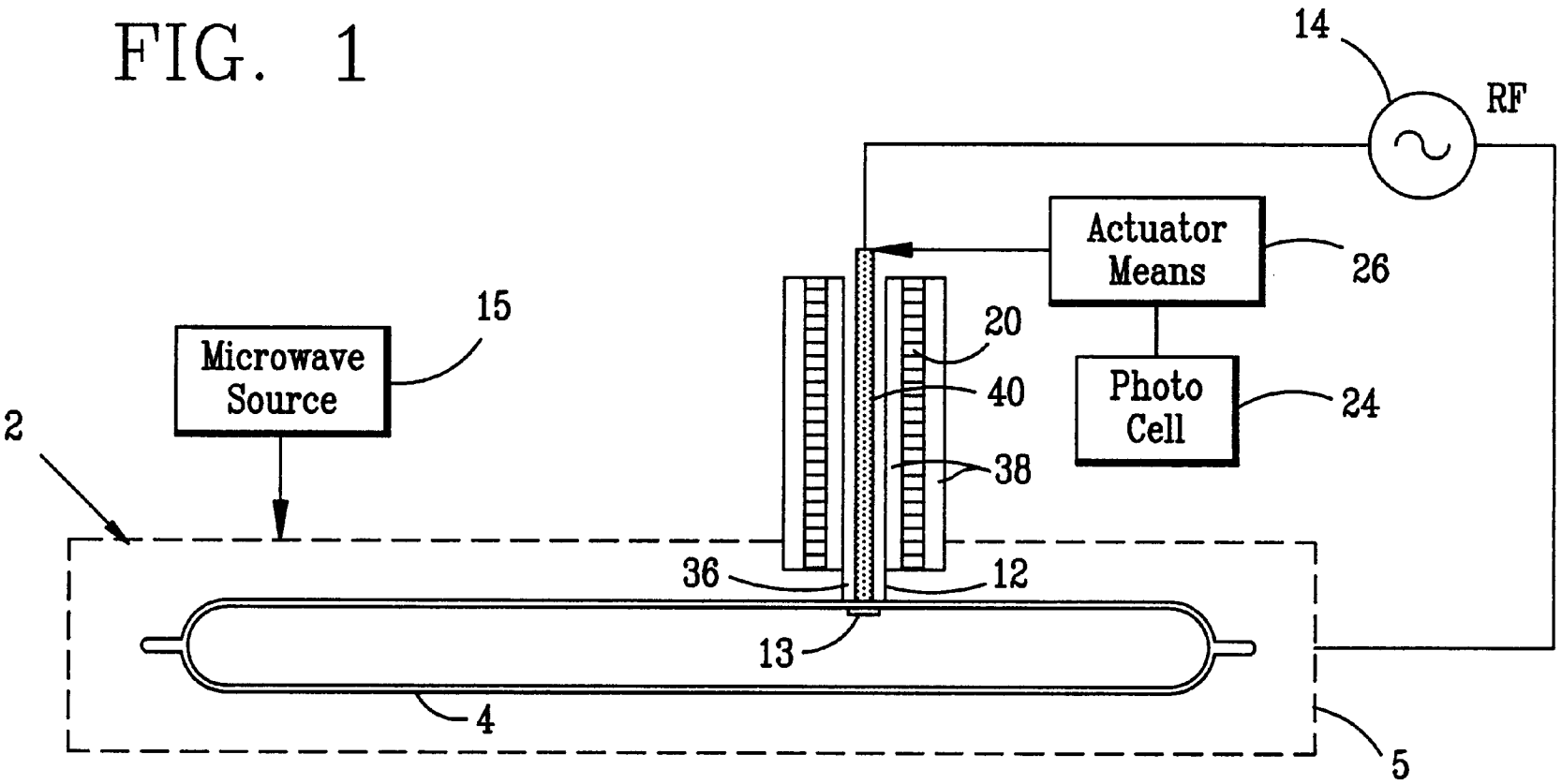
FIG. 1 is a schematic representation of a lamp system for a bulb according the present invention.

As best shown in FIG. 1, and electrodeless lamp 2 containing a bulb according to the present invention is shown. The lamp 2 is powered by a microwave energy from source 15. The bulb or envelope 4 contains a discharge forming fill as will be discussed in further detail below. The bulb 4 is located in a microwave enclosure 6 and in a preferred embodiment, the enclosure 6 is a microwave chamber or cavity comprising a reflector and a mesh that is transparent to the radiation emitted by the fill material within the bulb but which is also substantially reflective to microwave energy.

In addition to the microwave energy, it is conventional to apply auxiliary energy to start the lamp. For example, a small ultraviolet lamp irradiating the fill material may be used for this purpose.

The starting systems according to the present invention is shown and described in applicant's prior U.S. Pat. No. 5,838,108 to Frank et al. which is incorporated herein by reference. The starting system includes a starting electrode adapted to apply a high electric field at a given region of the bulb and at sufficient magnitude so as to cause field or secondary electron emission from the emission source. As a result, a sufficient number of electrons are generated to initiate the starting process of the lamp.

Turning to FIG. 1, a probe 40 is shown extending through an opening of a microwave cavity wall reflector (not shown) so that the tip 12 of the probe is within the proximity of the bulb 4. In a preferred embodiment, the tip 12 will contact the wall of the bulb so as to prevent arcing which would otherwise occur if an air gap were present.

To start, a series of RF pulses from an RF oscillator 14 is provided to the probe. The probe is provided with insulation to prevent arcing between the probe and the wall of the microwave cavity and/or the bulb. In a preferred embodiment, the insulation includes a heavy wall capillary tube or sidearms 36 of quartz material and an insulating polymer 20, for example, polytetrafluoroethylene (PTFE) contained in the insulating jacket 38.

The electron emission source 13 is disposed on the interior of the bulb or envelop at a region under the probe commonly known as the bulkhead. A substance comprising the electron emission source 13 is initially provided to the bulkhead region by adding the substance to the fill material, heating the bulb sufficient to cause the substance to decompose or sublimate, and then applying preferential cooling to cause the material to condense at the bulkhead region. The above deposition is effective prior to placing the bulb in the lamp. The electric field applied by the probe is of a sufficient magnitude so as to cause the field and/or secondary emission of electrons from substance 13. The electrons, in combination with the electric field from the probe, and the microwave field, thereby start the bulb. In a preferred embodiment, the RF pulse is applied in synchronism with the peak of the microwave field.

After the lamp start, the RF power is removed from the probe, the probe is retracted away from the lamp bulb and out of the interior of the cavity so as to prevent puncture and interference with microwave fields in the cavity. To accomplish this, a photodetector 24 is provided to detect the light emitted from the lamp and following processing of the signal, it is fed to an actuator 26 which includes a retraction device for retracting the probe.

Following use, the lamp is turned off by removing microwave power. When the lamp is on the off position, it is essential to ensure that the electron emitting source is at the bulkhead region, so that when the lamp is re-started, it will be available at this region where the starting electric field is applied. This may be accomplish either by arranging for the bulkhead to be the coolest region of the bulb, thereby promoting condensation of-the electron emitting source at this location, or by gravity, i.e arranging for the bulkhead to be at the lowest point in the bulb.

The bulb of the present invention and in accordance with the first and broadest aspects of the invention contains a high-pressure lamp fill material utilizing at least two excimer species, the total fill pressure in the bulb being above about 750 Torr at room temperature.

Excimer emission spectra are typically dominated by a single most probable transition, resulting in the nearly monochromatic spectra found in prior art bulbs. If the fill pressure is significantly less than 750 Torr, the above will remain true even if there are constituents available for the production of dissimilar excimer molecules.

Applicant's have discovered a strong relationship exists between pressure and output of the bulb. Bulb fill pressures above 750 Torr produce a condition of sufficient number densities within the bulb to permit competitive existence of at least two different excimer species simultaneously. By manipulating the partial pressures of the individual fill constituents, intensity of the spectral lines is optimized in a controlled manner. More particularly, by selectively increasing the partial pressure ratio of at least one of the individual constituents relative to the other of the individual constituents in an amount at least greater that about 0.05 to about 25, the intensity of the radiation resultant therefrom is increased the increase in radiation intensity is a function of the partial pressure ratio of the at least one of the individual constituents.

The fill according to the present invention comprises any of the inert noble gas; namely, He, Ne, Ar, Kr and Xe. An electronegative component such as halogen is also added. These halogens include fluorine, chlorine, bromine and iodine. In addition, a molecular dopant compound or compounds may be added. Molecular dopants include, but are not limited to $O_2$ and $N_2$, NO, $NO_2$, $SO_2$, CO, $CO_2$, OCS, $CS_2$ or other oxygen, nitrogen, sulphur and sulphur compounds or the like. A field or secondary electron emission source as described earlier may also be added and includes, for example, cesium, potassium, rubidium and sodium. While it is preferred to power the bulb using microwaves it is also within the scope of the present invention to employ AC or DC external electrodes, antennas, photons or particle beams.

In the preferred embodiment of the present invention, the fill provided within the bulb comprises materials that can form at least two dissimilar excimer wherein the intensities and line shapes of the excimer emission are a function of the quantity of the filling materials and available driving power. The spectrum can be continuously varied and thereby optimize for each particular application.

Figure 2:
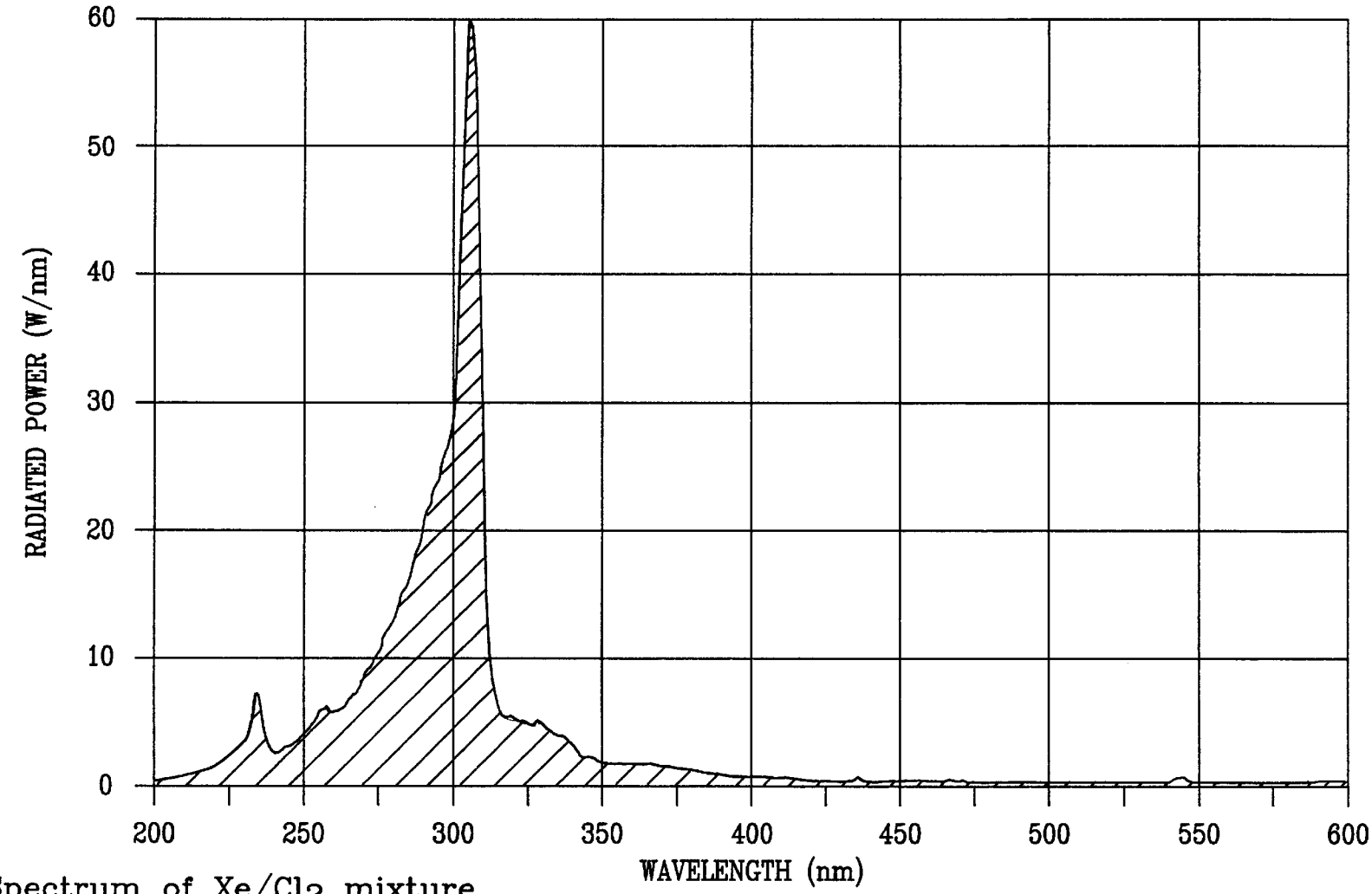
FIG. 2 illustrates the emission spectrum of a xenon chloride mixture.
Figure 3:
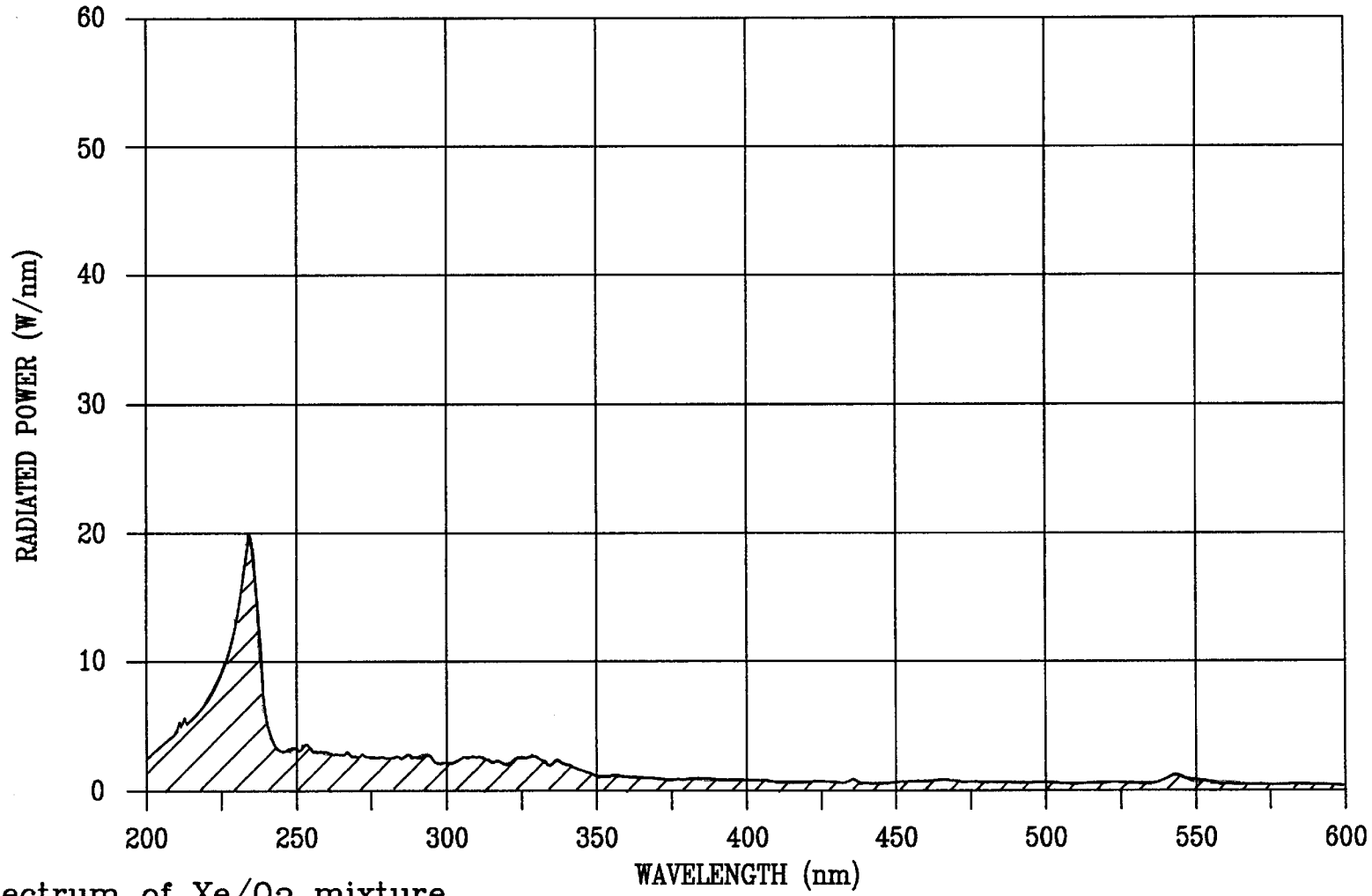
FIG. 3 illustrates the emission spectrum for a xenon oxide mixture.

FIG. 2, the dominant spectrum produced by a fill containing multiple excimer combination according to the present invention is shown wherein a $Xe/Cl_2$ mixture of a single excimer species having 1530 Torr xenon and 68 Torr chlorine at room temperature. FIG. 3 represents the dominant emission spectrum for a $Xe/O_2$ fill having 2000 Torr xenon and 100 Torr oxygen at room temperature. Lamps provided with bulbs having these fills may be used to cure a variety of films including, but not limited to, clear thin films of Irgacure® 184 or Darocur® 1173 or clear thick films of Darocur® 1173 and 1700.

Figure 4:
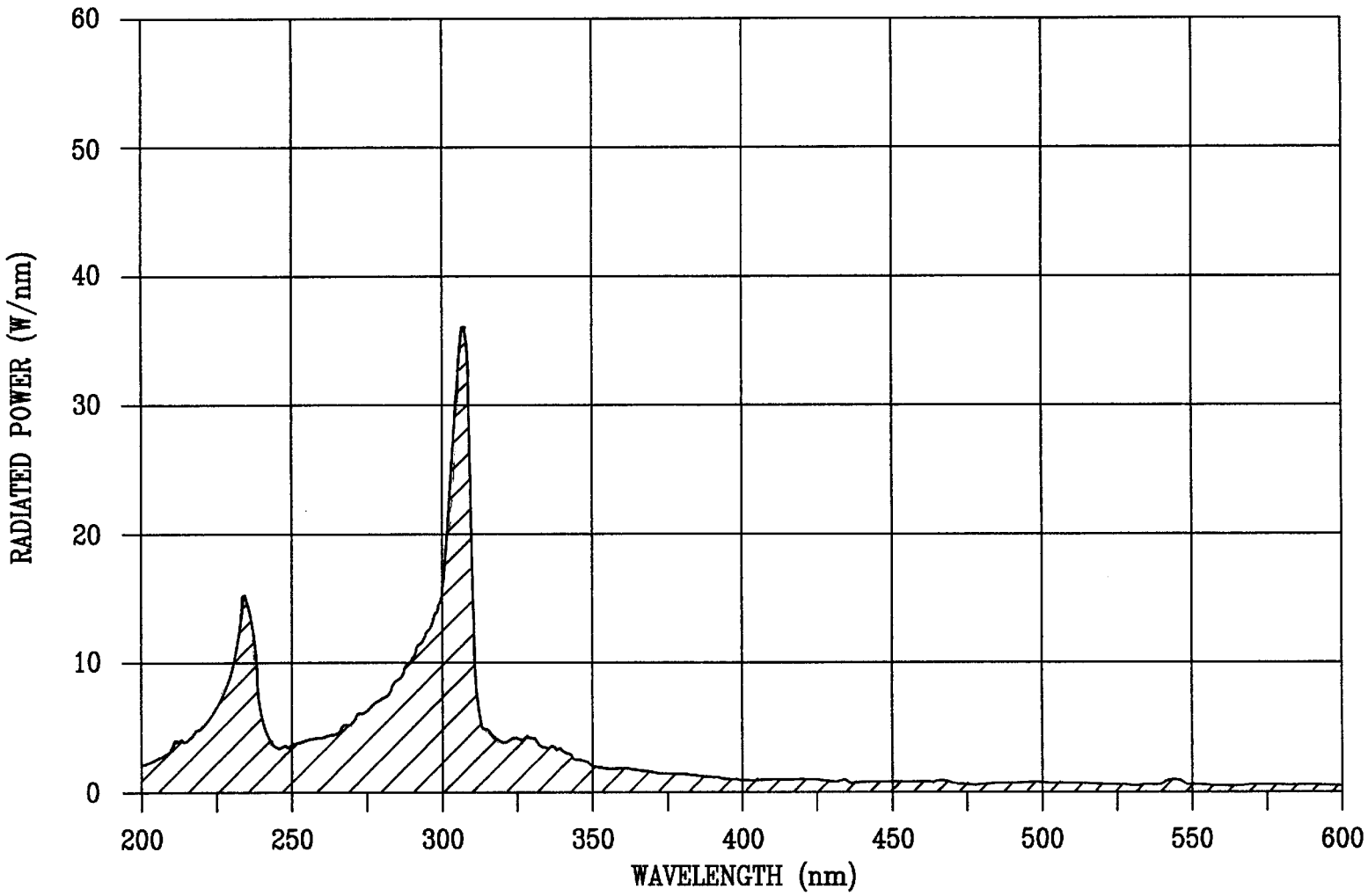
FIG. 4 illustrates the emission spectrum for a first example of a multi-excimer fill according to the present invention.

Turning to FIG. 4, the dominant emission spectrum produced by a fill according to the present invention is shown wherein a fill mixture of $Xe/Cl_2/O_2$ comprising 2000 Torr xenon, 100 Torr oxygen and 20 Torr chlorine at room temperature(25° C.) is provided to produce two emission, each from a separate excimer. As can be seen, two separate peaks of 308 nm and 234 nm are produced in a single emission, each peak having the desired radiated power output. The intensity and line shape of the excimer emission are a function of the quantity or density of the fill material together with available driving power for the lamp. Adjustment of the gas filling pressure for each compound will produce any of a variety of intermediate multiple spectrums between that shown in FIG. 2 and FIG. 3.

Figure 5:
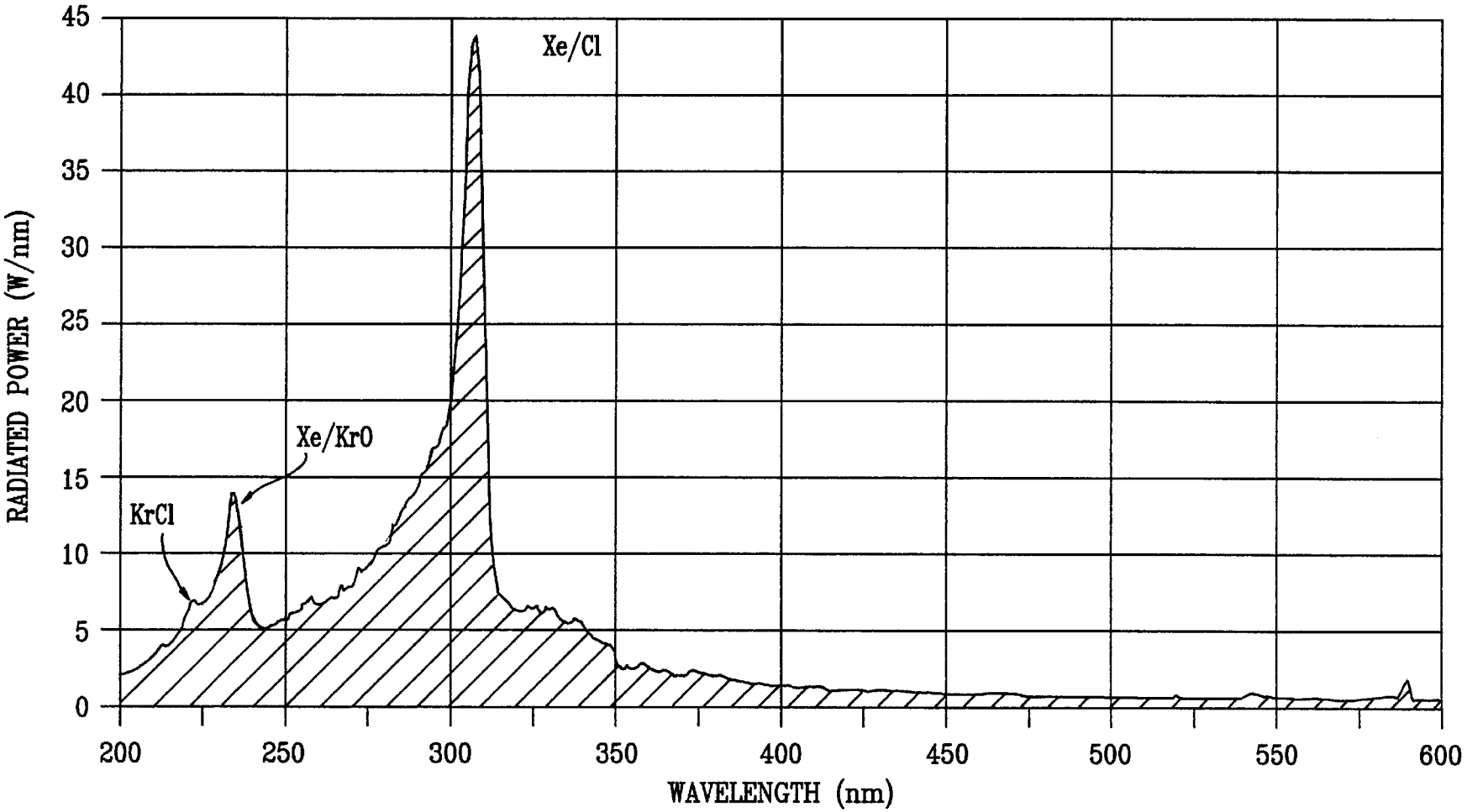
FIG. 5 illustrates the emission spectrum for a second example of a multi-excimer fill according to the present invention.

Turning to FIG. 5, the dominant emission spectrum produced by a second fill according to the present invention is shown wherein a fill mixture of $Xe/Kr/Cl_2/O_2$ comprising 1000 Torr xenon, 1000 Torr krypton, 40 Torr chlorine and 1000 Torr oxygen at room temperature (25° C.) is provided to produce three separate emissions, each from a separate excimer. Three separate peaks of 320 nm, 238 nm and 222 nm are produced in a single emission, each peak having the desired radiated power output. The examples of FIGS. 4 and 5 provide partial pressure ratios for the individual constituents extending from about 0.05 to about 25.

While this invention has been described as having preferred design, it is understood that it is capable of further modification, uses and/or adaptations following in general the principle of the invention and including such departures from the present disclosure as come within known or customary practice in the art to which the invention pertains, and as may be applied to the essential features set forth, and fall within the scope of the invention or the limits of the appended claims.

We claim:

1. A lamp bulb having an output adjusted for a desired application, the lamp bulb comprising:

a) an envelope for containing a fill material under pressure, said envelope is transparent to ultraviolet radiation;

b) a fill material, said fill material contained within said envelope and comprising individual constituents capable of forming at least two dissimilar excimer species, at least one of said individual constituents having a partial pressure ratio greater than the other of said individual constituents in an amount at least greater than about 0.05 to about 25 to provide a total fill pressure within said envelope no less than about 750 Torr at room temperature whereby upon energizing of said fill containing envelope in an amount sufficient to cause formation of said at least two dissimilar excimer species, the intensity of the radiation resultant therefrom is increased, the increase in radiation intensity is a function of the partial pressure ratio of said at least one of said individual constituents.

2. A lamp bulb as in claim 1 and wherein:

a) said fill material individual constituents selected from the group consisting of noble gases, and halogens.

3. A lamp bulb as in claim 1 and wherein:

a) said fill material individual constituents including at least one noble gas selected from the group consisting of helium, neon, argon, krypton and xenon.

4. A lamp bulb as in claim 1 and wherein:

a) said fill material individual constituents including at least one halogen selected from the group consisting of fluorine, chlorine, bromine and iodine.

5. A lamp as in claim 1 and wherein:

a) said fill material includes at least one molecular dopant selected from the group consisting of $O_2$ and $N_2$, NO, $NO_2$, $SO_2$, CO, $CO_2$, OCS and $CS_2$.

6. A lamp as in claim 1 and wherein:

a) said fill material comprising about 2000 Torr xenon, about 100 Torr oxygen and about 20 Torr chlorine.

7. A lamp as in claim 1 and wherein:

a) said fill material comprising about 1000 Torr xenon, about 1000 Torr krypton, about 40 Torr chlorine and about 1000 Torr oxygen.

8. The method of claim 1 and wherein:

a) said fill material further includes molecular dopants and ignition components.

9. A method of making a lamp bulb having an output adjusted for a desired application, the method including the steps of:

a) providing an envelope for containing a fill material under pressure, the envelope is transparent to ultraviolet radiation;

b) providing a fill material, the fill material comprising individual constituents capable of forming at least two dissimilar excimer species;

c) adding the fill material to the envelope; and d) selectively increasing the partial pressure ratio of at least one of the individual constituents relative to the other of the individual constituents in an amount at least greater than about 0.05 to about 25 and to provide a total fill pressure no less than about 750 Torr at room temperature so that upon energizing of the fill containing envelope sufficient to cause formation of at least two dissimilar excimer species, the intensity of the radiation resultant therefrom is increased, the increase in radiation intensity is a function of the selectively increased partial pressure ratio of the at least one of the individual constituents.

10. The method of claim 9 and wherein:

a) the fill material individual constituents are selected from the group consisting of noble gases, and halogens.

11. The method of claim 9 and wherein:

a) the fill material individual constituents include at least one noble gas selected from the group consisting of helium, neon, argon, krypton and xenon.

12. The method of claim 9 and wherein:

a) the fill material individual constituents at least one halogen selected from the group consisting of fluorine, chlorine, bromine and iodine.

13. The method of claim 9 and wherein:

a) the fill material includes at least one molecular dopant selected from the group consisting of $O_2$ and $N_2$, NO, $NO_2$, $SO_2$, CO, $CO_2$, OCS and $CS_2$.

14. The method of claim 9 and wherein:

a) the fill material further includes molecular dopants and ignition components.

* * * * *